US009165525B2

(12) United States Patent
Kobayashi et al.

(10) Patent No.: US 9,165,525 B2
(45) Date of Patent: Oct. 20, 2015

(54) DISPLAY DEVICE AND METHOD FOR DRIVING SAME

(75) Inventors: Fumiyuki Kobayashi, Osaka (JP); Taketoshi Nakano, Osaka (JP); Asahi Yamato, Osaka (JP); Kohji Saitoh, Osaka (JP); Ken Inada, Osaka (JP); Kohzoh Takahashi, Osaka (JP); Toshihiro Yanagi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 52 days.

(21) Appl. No.: 14/009,947

(22) PCT Filed: Apr. 4, 2012

(86) PCT No.: PCT/JP2012/059145

§ 371 (c)(1),
(2), (4) Date: Oct. 4, 2013

(87) PCT Pub. No.: WO2012/137799

PCT Pub. Date: Oct. 11, 2012

(65) Prior Publication Data

US 2014/0028657 A1 Jan. 30, 2014

(30) Foreign Application Priority Data

Apr. 8, 2011 (JP) ..... 2011-086812

(51) Int. Cl.
*G09G 3/36* (2006.01)

(52) U.S. Cl.
CPC ..... *G09G 3/3696* (2013.01); *G09G 3/3648* (2013.01); *G09G 3/3677* (2013.01); (Continued)

(58) Field of Classification Search
CPC ..... G06F 17/3033; G06F 9/30036; G06F 11/1446; G06F 11/302; G06F 11/3495; G06F 12/0837; G06F 12/0871; G06F 17/11; G06F 17/2705
See application file for complete search history.

(56) References Cited

U.S. PATENT DOCUMENTS

2002/0093473 A1 7/2002 Tanaka et al.
2002/0105492 A1 8/2002 Kosaka
(Continued)

FOREIGN PATENT DOCUMENTS

CN 1855211 A 11/2006
JP 2002-182619 A 6/2002
(Continued)

OTHER PUBLICATIONS

Official Communication issued in International Patent Application No. PCT/JP2012/059145, mailed on May 22, 2012.

*Primary Examiner* — Olga Merkoulova
(74) *Attorney, Agent, or Firm* — Keating & Bennett, LLP

(57) ABSTRACT

In an intermittent drive mode of a display device in which driving and pausing of the driving are repeated, an image identification section identifies an input image as a still image or a moving image. In a case where the moving image is identified, a drive/pause control section generates a drive/pause control signal with a period ratio in accordance with the moving image. A timing control section generates a driver control signal so that intermittent driving is carried out. Then, a source driver and a gate driver drives a display section so that the drive period and the pause period are repeated with a predetermined period ratio, so that the input image is displayed. The drive/pause control section sets a time ratio between the drive period and the pause period to be variable for each of the moving image and the still image.

11 Claims, 11 Drawing Sheets

(52) U.S. Cl.
CPC ..... *G09G3/3688* (2013.01); *G09G 2310/0248* (2013.01); *G09G 2310/0291* (2013.01); *G09G 2320/103* (2013.01); *G09G 2330/021* (2013.01); *G09G 2330/022* (2013.01)

(56) References Cited

U.S. PATENT DOCUMENTS

2002/0180673 A1* 12/2002 Tsuda et al. ..... 345/87
2003/0043129 A1 3/2003 Tazuke
2006/0050043 A1* 3/2006 Kawagoe ..... 345/98
2006/0244710 A1 11/2006 Iriguchi et al.
2007/0205976 A1* 9/2007 Takatori et al. ..... 345/100

FOREIGN PATENT DOCUMENTS

JP 2002-229525 A 8/2002
JP 2002-278523 A 9/2002
JP 2003-066919 A 3/2003
JP 2007-272203 A 10/2007

* cited by examiner

DISPLAY DEVICE AND METHOD FOR DRIVING SAME

TECHNICAL FIELD

The present invention relates to (i) a display device in which not only a drive period but also a pause period in which no driving is carried out is provided so that less electric power is consumed, and (ii) a method for driving the display device.

BACKGROUND ART

In recent years, display devices have been popularly used which are thin, lightweight, and low in electric power consumption, and are typified by liquid crystal display devices. Such a display device is suitably provided to, for example, a device such as a mobile phone, a smartphone, or a tablet terminal so that the device is smaller in size and lighter in weight. Such a device, in which a storage battery is used as a voltage source, is required to consume less electric power. Accordingly, the display device to be provided to the device is also required to consume less electric power.

In order to maintain a stable display state, the display device carries out refresh driving such that an identical image is repeatedly displayed at regular intervals (i.e., an image is rewritten). However, since electric power is consumed in the refresh driving, an attempt has been made to reduce the electric power consumption.

For example, Patent Literature 1 discloses a driving method in which after a screen is scanned, a pause period is provided (i) which is a non-scanning period longer than a scanning period in which the screen is scanned one time and (ii) in which all scanning signal lines are in a non-scanning state. In a case where such a pause period is provided, it is possible to reduce electric power consumption.

Moreover, according to the driving method, it is detected whether or not image data changes, and the pause period is provided so as to vary in accordance with an unchanging image (still image) or a changing image (moving image). Specifically, in the case of the still image (a still image mode), a scanning period (one frame) and the pause period are alternately repeated, whereas in the case of the moving image (a moving image mode), a plurality of scanning periods and one pause period are repeated. According to this, especially in a case where the moving image is displayed, it is possible to ensure a sufficient response speed at the display, and to easily and sufficiently reduce electric power consumption while basic display qualities such as a brightness, a contrast, a response speed, and a graduation characteristic are satisfied. Furthermore, while optimum display qualities of the still image and the moving image are satisfied, electric power consumption can be reduced by causing an image to be rewritten fewer times.

CITATION LIST

Patent Literature

Patent Literature 1
Japanese Patent Application Publication, No. 2002-278523 A (Publication Date: Sep. 27, 2002)

SUMMARY OF INVENTION

Technical Problem

According to the driving method described in Patent Literature 1, in a case where a moving image is displayed, driving is carried out in a cycle in which a pause period is provided after a scanning period of one frame is repeated a plurality of times. Therefore, in order to further reduce electric power consumption, it is necessary to set the pause period to be longer. However, a too long pause period causes a trouble such that an image of each frame does not smoothly change, so that the moving image has a lower display quality.

Moving images are frequently displayed in recent mobile phones, smartphones, tablet terminals, and the like. Accordingly, a display device which is used for such a device is further required to increase a display quality of a moving image and to reduce electric power consumption. Meanwhile, in a case where a still image is displayed, its display quality does not deteriorate even if the pause period is set to be long to some extent. Therefore, the trouble unique to the moving image does not occur in the still image.

Accordingly, the display device is required to carry out driving such that during the display of the still image, a reduction in electric power consumption is prioritized since the display quality is ensured, whereas during the display of the moving image, electric power consumption is reduced while the display quality does not deteriorate.

The present invention has been made in view of the problems, and an object of the present invention is to provide (i) a display device capable of appropriately driving in accordance with a moving image and a still image and (ii) a method for driving the display device.

Solution to Problem

In order to attain the object, a display device of the present invention includes: a plurality of pixels provided in a matrix pattern; a drive circuit which supplies a data signal to each of the plurality of pixels by line-sequentially selecting the plurality of pixels; image identification means for identifying an input image as a still image or a moving image; drive/pause controlling means for controlling the drive circuit so that a drive period in which driving is carried out and a pause period in which the driving is paused are provided in one frame in a case where the image identification means identifies the input image as the moving image and so that the drive period and the pause period are provided in units of one or more frames in a case where the image identification means identifies the input image as the still image; and ratio setting means for setting a time ratio between the drive period and the pause period so that the time ratio is variable for each of the still image and the moving image.

In order to attain the object, a method for driving the display device of the present invention including: a plurality of pixels provided in a matrix pattern; and a drive circuit which supplies a data signal to each of the plurality of pixels by line-sequentially selecting the plurality of pixels, the method includes: an image identification step of identifying an input image as a still image or a moving image; a drive/pause controlling step of controlling the drive circuit so that a drive period in which driving is carried out and a pause period in which the driving is paused are provided in one frame in a case where the input image is identified as the moving image in the image identification step and so that the drive period and the pause period are provided in units of one or more frames in a case where the input image is identified as the still image in the image identification step; and a ratio setting step of setting a time ratio between the drive period and the pause period so that the time ratio is variable for each of the still image and the moving image.

According to the configuration, in a case where the image identification means (image identification step) identifies the input image as the moving image, the drive/pause controlling means (drive/pause controlling step) causes, in one frame, the drive circuit to carry out driving during the drive period and to pause the driving during the pause period. This causes the driving to be paused after completion of the refresh driving in less than one frame. This allows a reduction in electric power consumption in units of frames. Meanwhile, in a case where the image identification means (image identification step) identifies the input image as the moving image, the drive/pause controlling means (drive/pause controlling step) causes the drive circuit, in units of one or more frames, to carry out the driving during the drive period and to pause the driving during the pause period. Therefore, the driving is carried out at a higher speed during the display of the moving image, whereas the driving is carried out at a lower speed during the display of the still image.

Moreover, the ratio setting means (ratio setting step) sets the time ratio so that the time ratio is variable for each of the still image and the moving image. This makes it possible to change the time ratio in accordance with performance of the display device or a state of the input image. Since the time ratio is set to be variable, in a case where the ratio setting means is storage means, a desired ratio can be retained by rewriting the ratio as appropriate. This makes it possible to appropriately drive the display device in accordance with the moving image and the still image.

Advantageous Effects of Invention

A display device of the present invention which display device is configured as described above yields an effect of being driven in accordance with a moving image and a still image.

Figure 2:
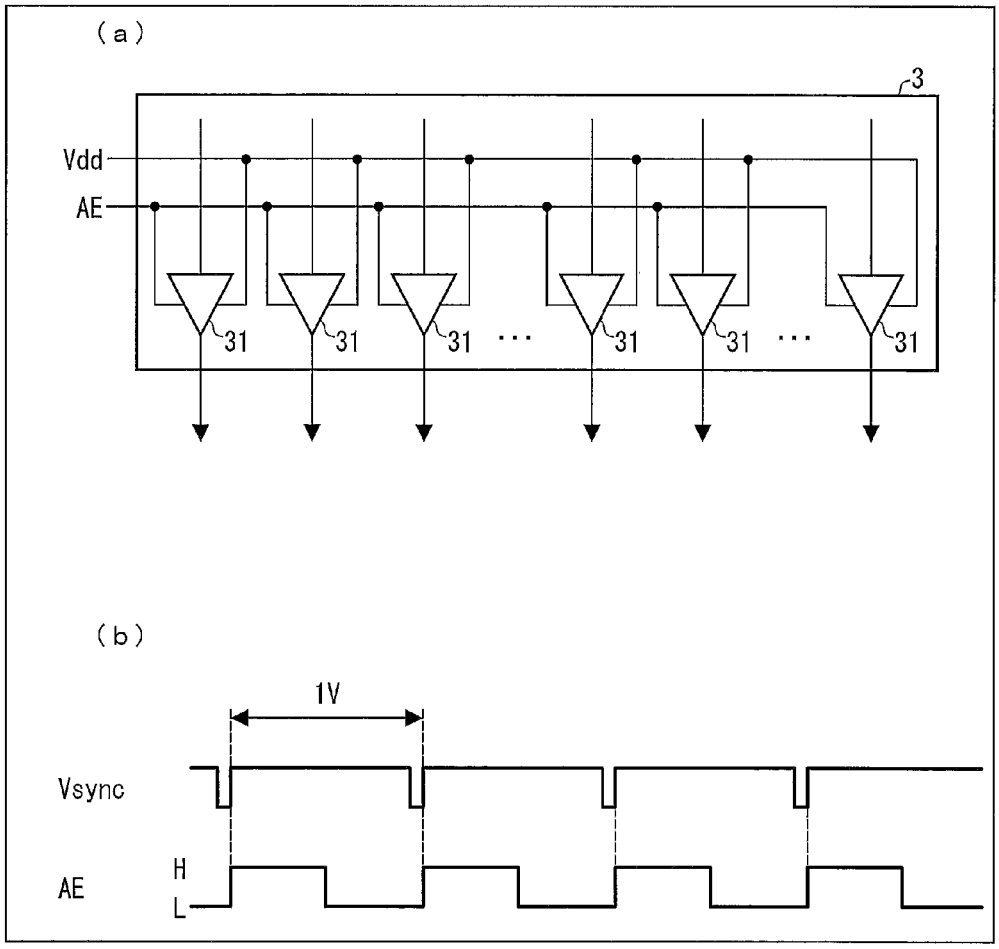

(a) of FIG. 2 is a circuit diagram illustrating a configuration of an output stage of a source driver of the display device. (b) of FIG. 2 is a waveform chart illustrating an amplifier enable signal which is supplied to each of source amplifiers in the output stage.

Figure 3:
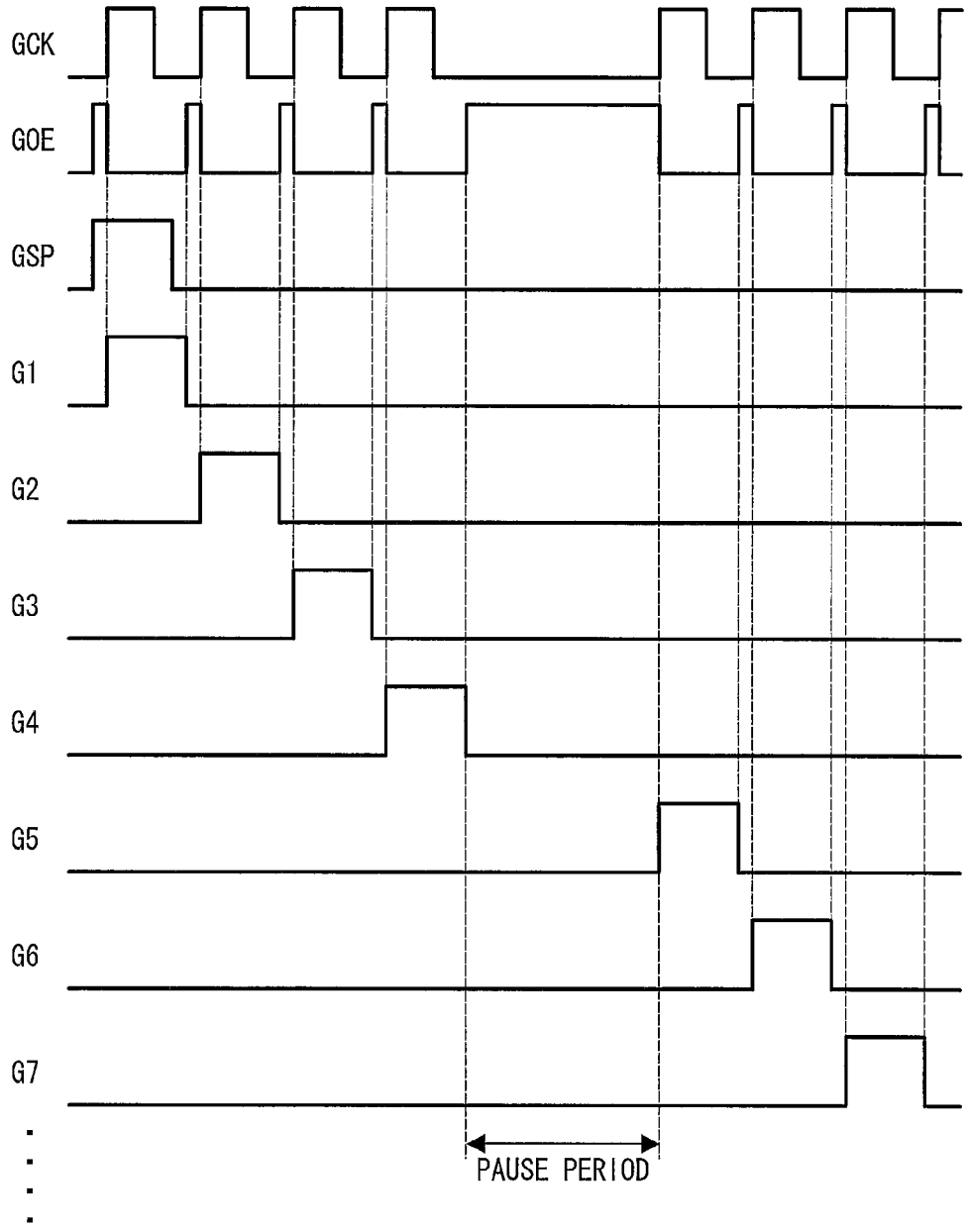

FIG. 3 is a waveform chart showing a control signal which is supplied to a gate driver of the display device and a gate signal which is supplied from the gate driver.

Figure 4:
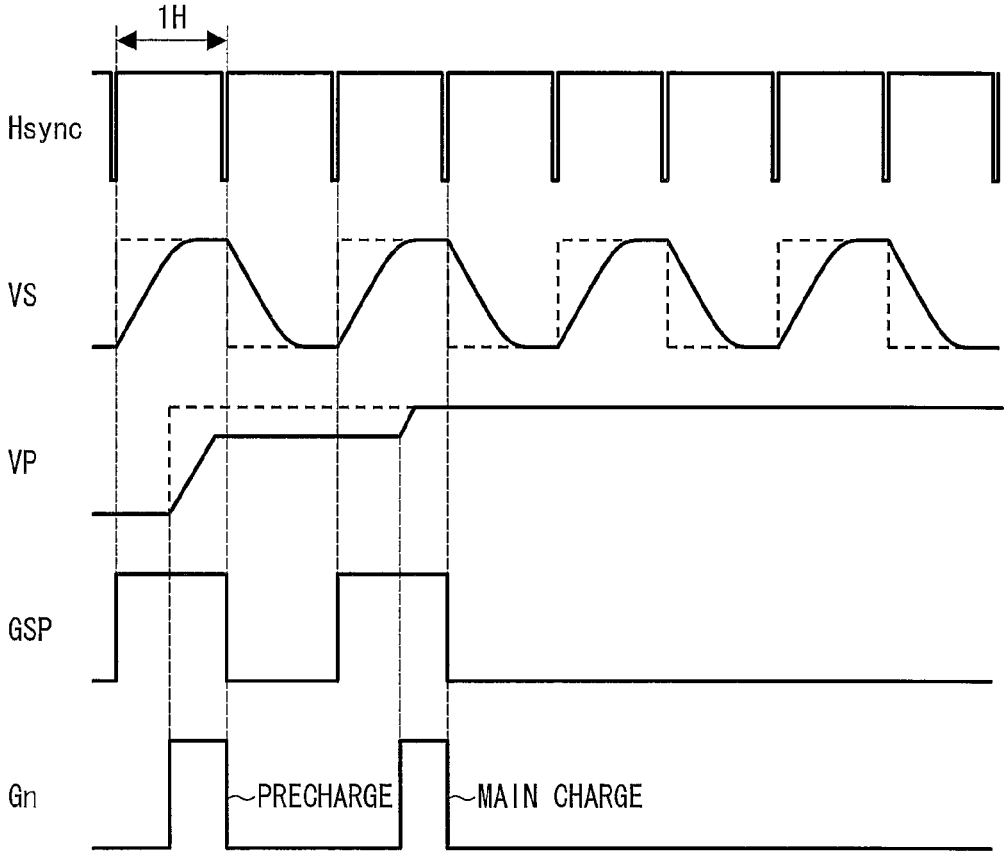

FIG. 4 is a timing chart showing precharge operations carried out by the source driver and the gate driver.

Figure 5:
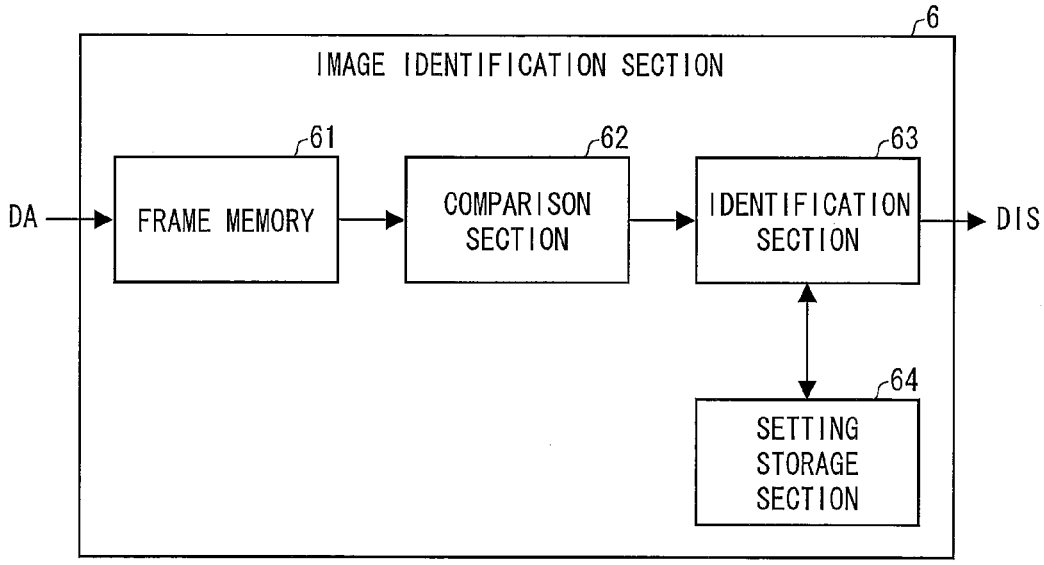

FIG. 5 is a brock diagram illustrating a configuration of an image identification section of the display device.

Figure 6:
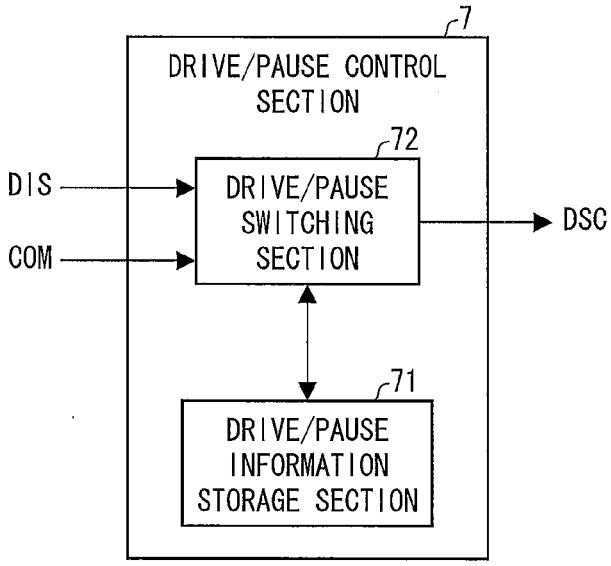

FIG. 6 is a brock diagram illustrating a configuration of a drive/pause control section of the display device.

Figure 7:
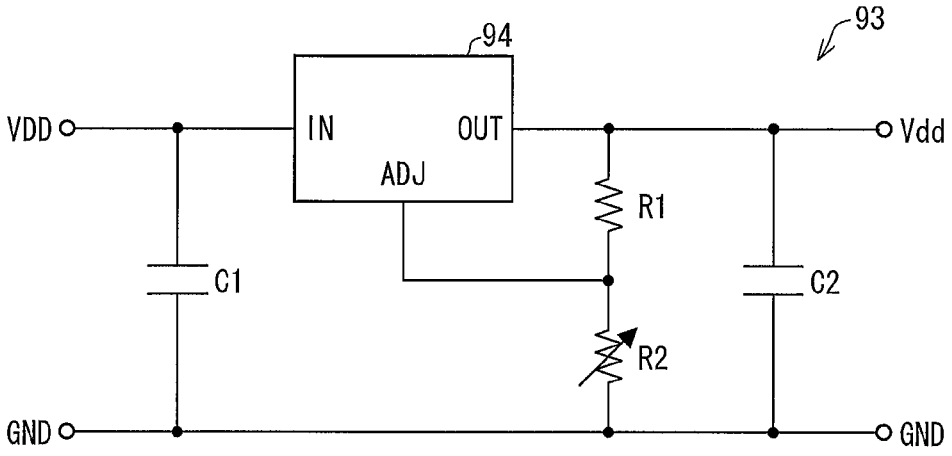

FIG. 7 is a circuit diagram illustrating a configuration of a regulator for the source amplifiers which regulator is provided in a power supply circuit of the display device.

Figure 8:
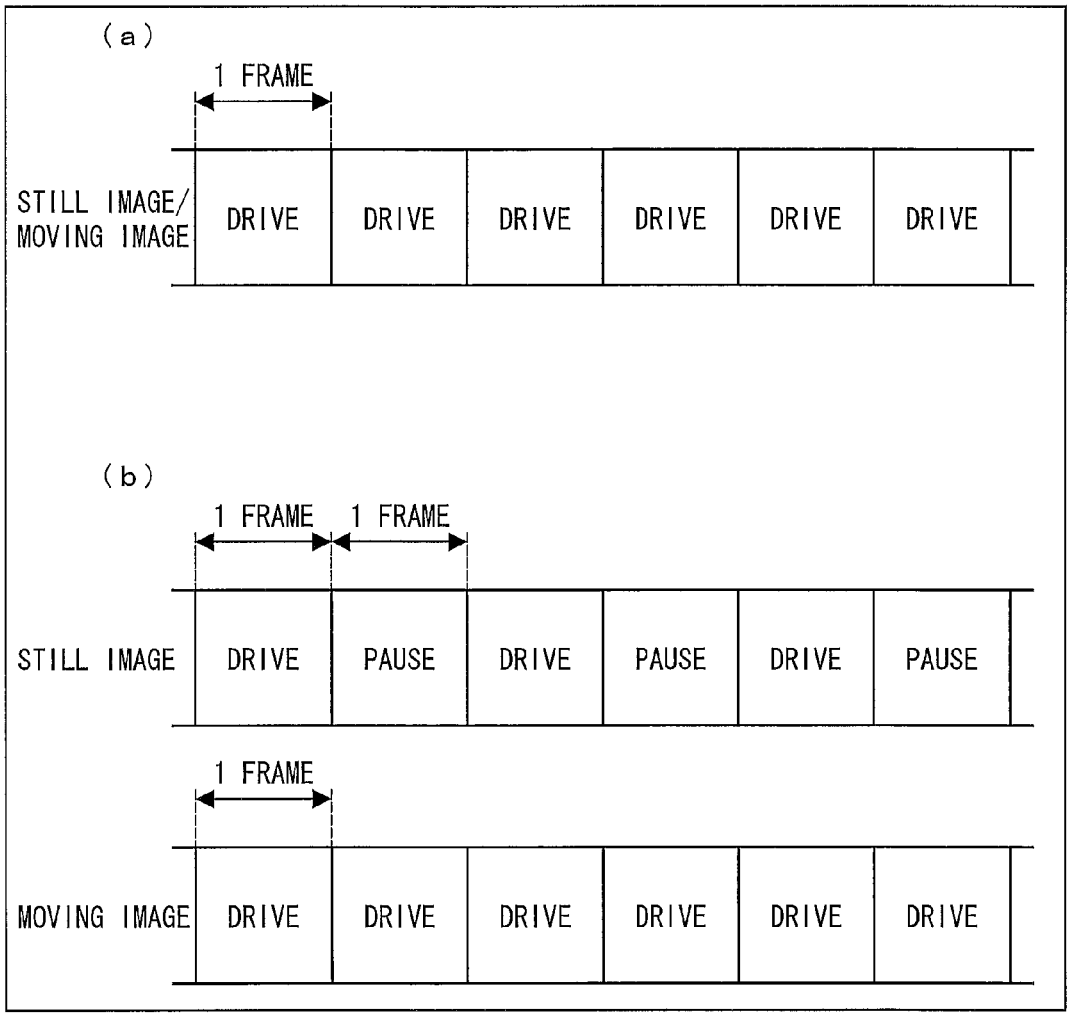

(a) of FIG. 8 is a view showing a drive pattern in a normal drive mode. (b) of FIG. 8 is a view showing a drive pattern in a first intermittent drive mode.

Figure 9:
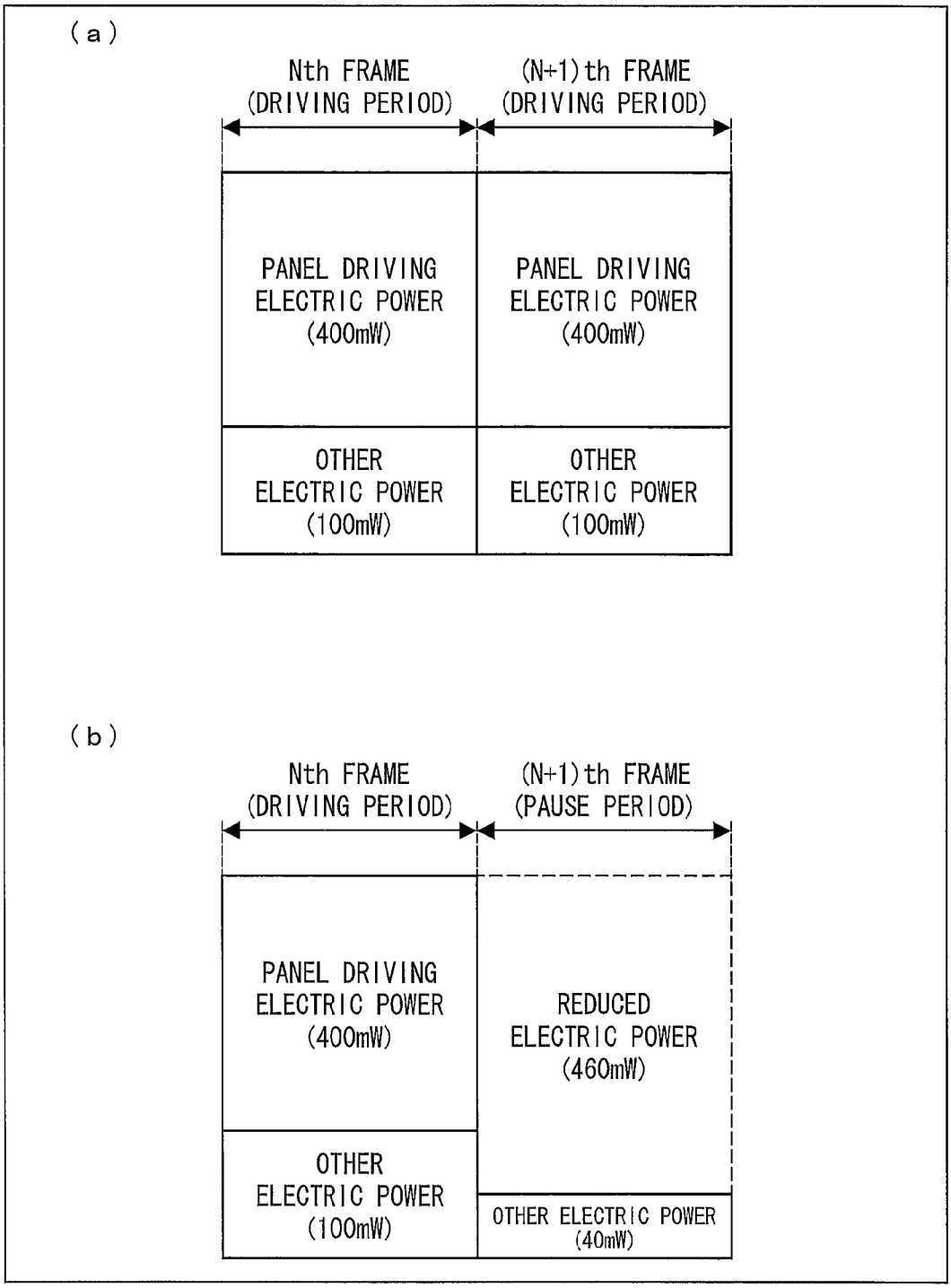

(a) of FIG. 9 is a view showing electric power consumption in a case where a still image is displayed in the drive pattern shown in (a) of FIG. 8. (b) of FIG. 9 is a view showing electric power consumption in a case where a still image is displayed in the drive pattern shown in (b) of FIG. 8.

Figure 10:
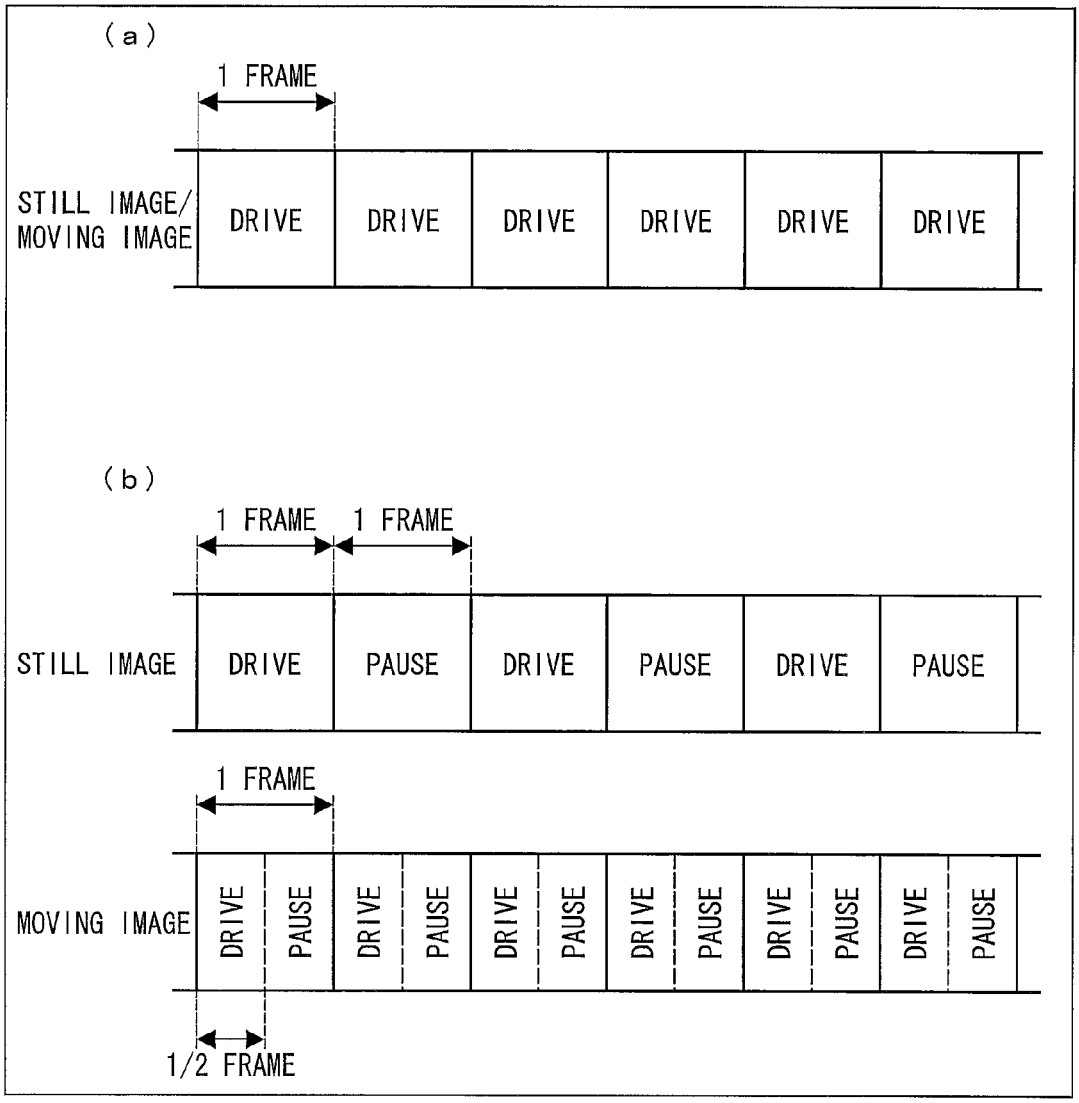

(a) of FIG. 10 is a view showing the drive pattern in the normal drive mode. (b) of FIG. 10 is a view showing a drive pattern in a second intermittent drive mode.

Figure 11:
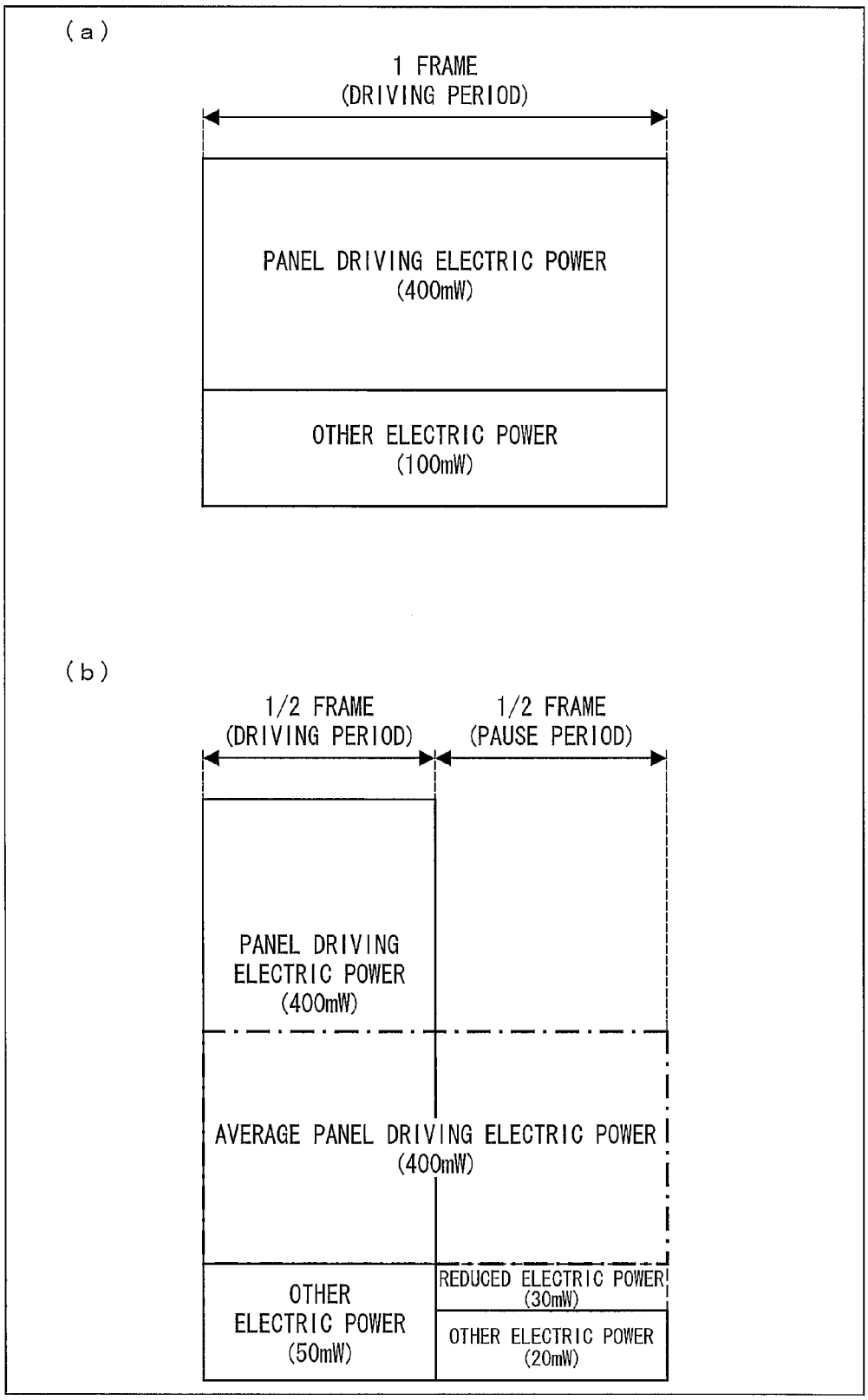

(a) of FIG. 11 is a view showing electric power consumption in a case where a moving image is displayed in the drive pattern shown in (a) of FIG. 10. (b) of FIG. 11 is a view showing electric power consumption in a case where a moving image is displayed in the drive pattern shown in (b) of FIG. 10.

Figure 12:
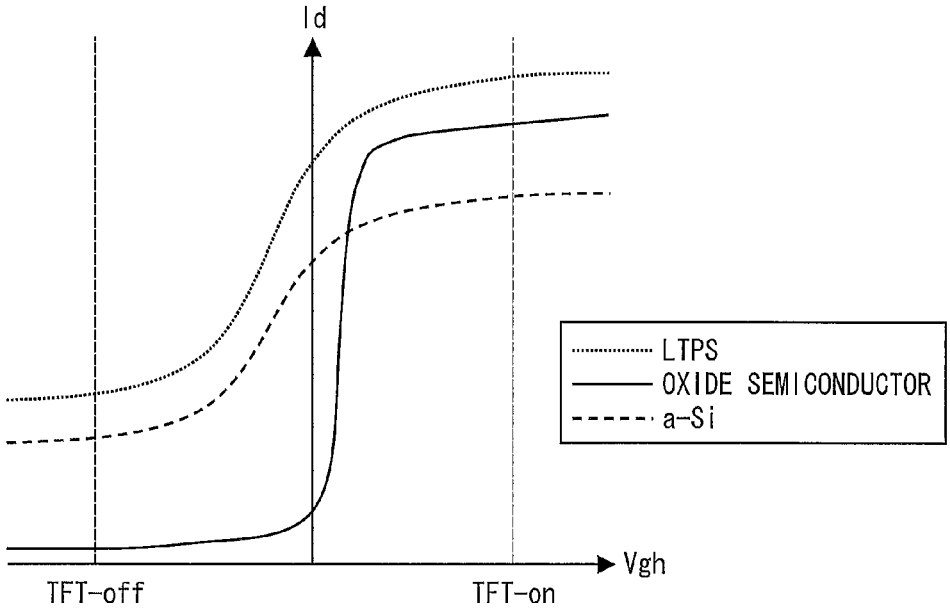

FIG. 12 is a graph showing characteristics of a thin film transistor included in a pixel which constitutes a display panel of the display device.

DESCRIPTION OF EMBODIMENTS

The following describes an embodiment of the present invention with reference to FIGS. 1 through 12.

[Configuration of Display Device]

Figure 1:
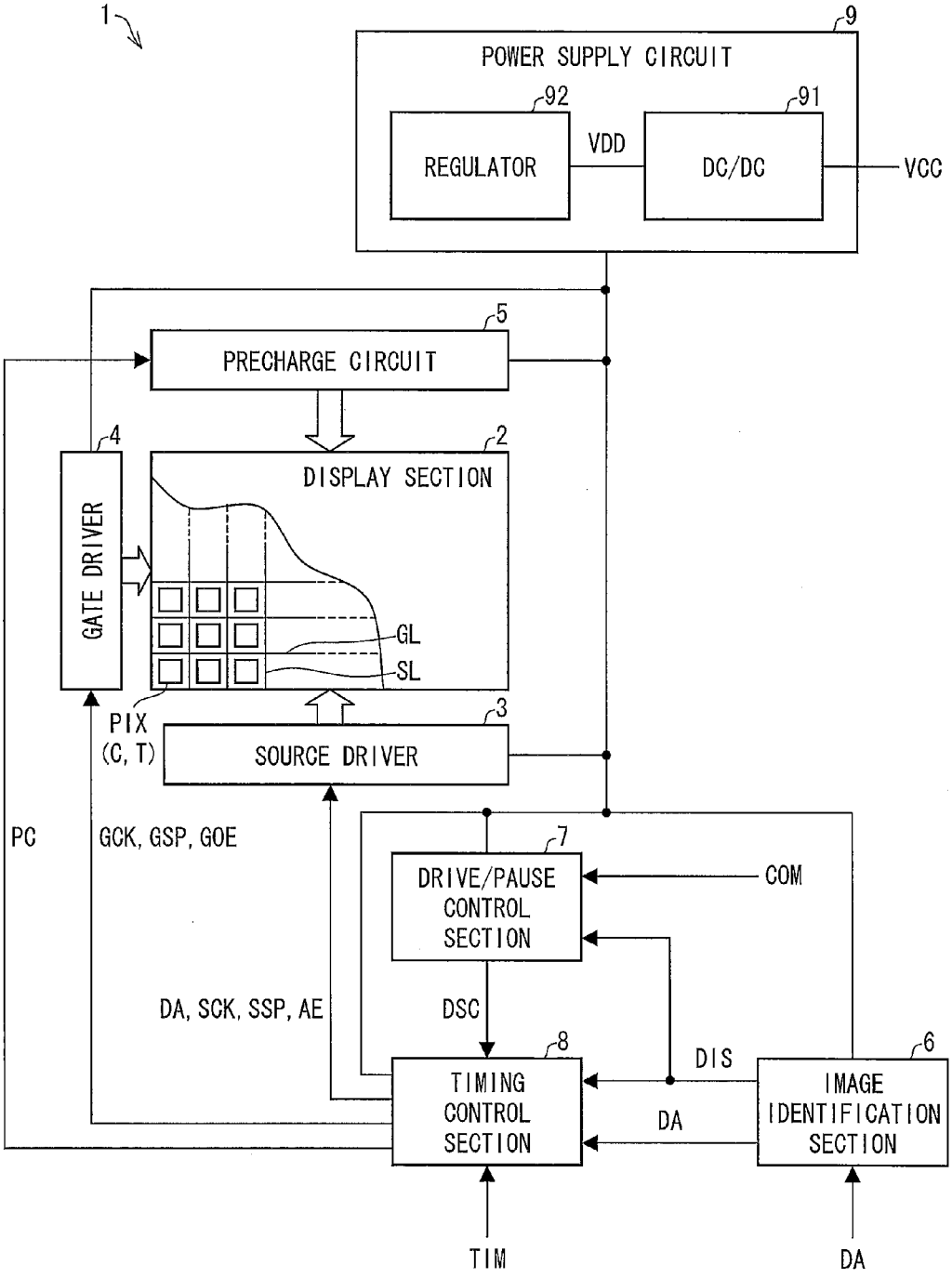
FIG. 1 is a brock diagram illustrating a configuration of a relevant part of a display device of an embodiment of the present invention.

FIG. 1 illustrates an overall configuration of a display device 1 of the present embodiment. The present embodiment discusses an example in which the display device 1 is a liquid crystal display device. However, the present invention is not limited to the liquid crystal display device (described later).

The display device 1 includes a display section 2, a source driver 3, a gate driver 4, a precharge circuit 5, an image identification section 6, a drive/pause control section 7, a timing control section 8, and a power supply circuit 9 (see FIG. 1).

<Configuration of Display Section>

The display section 2 includes a display panel and a backlight device. The display panel includes an active matrix substrate, a counter substrate, and a liquid crystal which is provided between the active matrix substrate and the counter substrate. The active matrix substrate includes a plurality of gate lines GL provided in parallel and a plurality of source lines SL provided in parallel. The plurality of gate lines GL and the plurality of source lines SL intersect with each other. A plurality of pixels PIX is provided near intersections of the plurality of gate lines GL and the plurality of source lines SL. Therefore, the plurality of pixels PIX is provided in a matrix pattern in the display panel. The plurality of pixels PIX each includes a liquid crystal capacitor C and a transistor T (thin film transistor). The liquid crystal capacitor C (not illustrated) is defined by a pixel electrode provided on the active matrix substrate, a common electrode provided on the counter substrate, and a liquid crystal provided between the pixel electrode and the common electrode.

A line is constituted by pixels PIX connected to a gate line GL. In order to supply a gate signal to each of the pixels PIX belonging to the line, the gate line GL transmits a gate signal supplied from the gate driver 4. In order to supply a data signal to each of selected pixels PIX, a source line SL transmits a data signal supplied from the source driver 3.

According to the display section 2, when the transistor T of each of the pixels PIX is turned on by the gate signal supplied to the gate line GL, the data signal supplied from the source line SL is captured by the each of the pixels PIX and written to the pixel electrode. This causes a voltage in accordance with the data signal to be applied to the liquid crystal capacitor C, so that an orientation state of the liquid crystal changes. As a result, light is emitted from the backlight device while being modulated in accordance with the data signal, so that an image is displayed in a tone in accordance with the data signal.

<Configuration of Source Driver>

(a) of FIG. 2 illustrates a configuration of an output stage of the source driver 3. (b) of FIG. 2 illustrates an amplifier enable signal AE which is supplied to each of source amplifiers 31 in the output stage.

The source driver 3 (drive circuit, data signal output circuit) (i) stores image data DA for one row at a timing generated by a shift register, the image data DA being supplied from the timing control section 8, and (ii) supplies the image data DA to each of the plurality of source lines SL. Specifically, the shift register of the source driver 3 outputs the source start pulse SSP by sequentially shifting the source start pulse SSP in synchronization with a source clock SCK. The source start pulse SSP and the source clock SCK are provided by the timing control section 8 (described later).

The source driver 3 includes the source amplifiers 31 (amplifiers) which are identical to the source lines SL in number and are provided in the output stage (see (a) of FIG. 2). The source amplifiers 31, which are constituted by analog amplifiers, operate under control of the amplifier enable signal AE supplied from the timing control section 8. Specifically, the source amplifiers 31 operate in a case where the amplifier enable signal AE is "H", and the source amplifiers 31 do not operate in a case where the amplifier enable signal AE is "L". Furthermore, a variable supply voltage Vdd is applied to each of the source amplifiers 31. This causes the source amplifiers 31 to increase their capability in a case where the supply voltage Vdd increases and to reduce their capability in a case where the supply voltage Vdd decreases.

<Configuration of Gate Driver>

FIG. 3 shows a control signal which is supplied to the gate driver 4 and a gate signal which is supplied from the gate driver 4.

In accordance with a gate start pulse GSP, a gate clock GCK, and a gate enable signal GOE which are supplied from the timing control section 8, the gate driver 4 (drive circuit, selection circuit) generates gate signals G1 through G7, . . . which are to be supplied to the respective gate lines GL (see FIG. 3). Specifically, during a period in which the gate enable signal GOE is "L" (active), the gate driver 4 causes the shift register to sequentially shift the gate start pulse GSP in synchronization with the gate clock GCK so as to output the gate signals G1 through G7, . . . . The gate driver 4 line-sequentially selects the gate lines GL by outputting the gate signals G1 through G7, . . . . In other words, the gate driver 4 line-sequentially selects the plurality of pixels PIX.

<Configuration of Precharge Circuit>

The precharge circuit 5 (precharging means) supplies a precharge voltage to a source line SL in a line two or three lines before a line in which the data signal is written to the pixels PIX belonging to the line. According to the precharge circuit 5, an operation of outputting the precharge voltage is controlled by a precharge control signal PC supplied from the timing control section 8. As described above, the precharge circuit 5 carries out a precharge operation of applying, in advance of the driving, a given voltage to each of pixels PIX belonging to an identical line.

<Other Precharge Functions>

FIG. 4 is a timing chart showing precharge operations carried out by the source driver 3 and the gate driver 4.

The source driver 3 and the gate driver 4 each can carry out a function similar to that of the precharge circuit 5. The following description specifically discusses this.

The source driver 3 outputs a voltage (signal voltage) of a data signal which changes so that a change from/to an increase to/from a decrease repeatedly occurs for each 1H which is defined by a horizontal synchronizing signal Hsync (see FIG. 4). The timing control section 8 outputs, in synchronization with the signal voltage, the gate start pulse GSP which has two high-level periods between which an interval of 1H is provided in each frame. For each of the gate lines GL, the gate driver 4 outputs, in accordance with the gate start pulse GSP, the gate signal which has only two high-level periods between an interval of 1H is provided in one frame. FIG. 4 shows an example in which a gate signal Gn is supplied to a gate line GLn.

According to this, pixels PIX connected to the gate line GLn are configured such that the transistor T is turned on by the gate signal Gn which is supplied first from the gate driver 4 in one frame. Then, a source electric potential VS of the transistor T changes so as to be increased by the signal voltage (see FIG. 4). In this case, a pixel electrode electric potential VP of the pixel electrode connected to a drain of the transistor T changes to a high value by the source electric potential VS thus increased and is retained by the liquid crystal capacitor C. This causes the liquid crystal capacitor C to be subjected to precharge. In this state, the pixel electrode electric potential VP of each of the pixels PIX does not reach a given voltage at which an image is displayed.

In a line two lines after a line subjected to the precharge, in the identical pixel PIX, the transistor T is turned on by a gate signal Gn which is supplied next from the gate driver 4. In this case, the source electric potential VS is increased by application of the signal voltage, so that the pixel electrode electric potential VP is changed to have a higher value and is retained by the liquid crystal capacitor C. This causes the liquid crystal capacitor C to be subjected to main charge. In this state, the pixel electrode electric potential VP of the each of the pixels PIX reaches the given voltage at which an image is displayed.

According to the examples described above, the precharge is carried out in a line two lines before a line in which the main charge is carried out.

<Configuration of Image Identification Section>

FIG. 5 illustrates a configuration of the image identification section 6.

The image identification section 6 (image identification means) identifies a type of image data DA received. In order to carry out the identification, the image identification section 6 includes a frame memory 61, a comparison section 62, an identification section 63, and a setting storage section 64 (see FIG. 5).

The frame memory 61 retains the image data DA received for two successive frames. The comparison section 62 compares, in units of dots, the image data DA (input images) for both the two successive frames which image data is retained by the frame 61, and then determines whether or not the image data for both the two successive frames match with each other.

As a result of the comparison by the comparison section 62, the identification section 63 (i) identifies the input images as moving images in a case where a ratio of dots at which the input images do not match with each other with respect to the entire dots is not less than a predetermined reference ratio and (ii) identifies the input images as still images in a case where the ratio of dots at which the input images do not match with each other with respect to the entire dots is less than the predetermined reference ratio. According to this, the identification section 63 can identify both the input images as still images in a case where the input images perfectly match with each other. Meanwhile, the identification section 63 can identify both the input images as still images in a case where the input images partially but mostly match with each other.

The reference ratio is stored in advance in the setting storage section 64 as a set value and is read out by the identification section 63. Note that the reference ratio is changeable and can be freely set by a user.

The identification section 63 outputs an image identification signal DIS as a result of the identification of types of both the input images. For example, the image identification signal DIS indicates, as a binary signal, a result of the identification as a still image and a moving image. Note that the image identification signal DIS can use the binary signal in a case where there exists another image to be identified.

Furthermore, the identification section 63 identifies an input image not in a normal drive mode but in an intermittent drive mode. The normal drive mode is a drive mode in which normal driving is carried out. The intermittent drive mode is a drive mode in which driving is intermittently carried out by repeatedly providing the drive period and the pause period (which are described earlier). Further, the intermittent drive mode includes a first intermittent drive mode in which only a still image is intermittently driven and a second intermittent drive mode in which both a still image and a moving image are intermittently driven. It is set as a frag for the setting storage section 64 which of the normal drive mode and the intermittent drive mode (the first intermittent drive mode or the second intermittent drive mode) is active. For example, the user sets which of the normal drive mode and the intermittent drive mode is active.

<Configuration of Drive/Pause Control Section>

FIG. 6 illustrates a configuration of the drive/pause control section 7.

The drive/pause control section 7 (drive/pause controlling means) determines, in accordance with the result of the identification of the input image by the image identification section 6 (image identification signal DIS), which of the pause period in accordance with a still image and the pause period in accordance with a moving image is to be provided. Meanwhile, in a case where the image identification section 6 identifies no image (in the case of the normal drive mode), the drive/pause control section 7 determines to carry out the normal driving without providing the pause period. For this end, the drive/pause control section 7 includes a drive/pause information storage section 71 and a drive/pause switching section 72 (see FIG. 6).

The drive/pause information storage section 71 (ratio setting means, storage means) stores information on a time ratio (period ratio) between the drive period and the pause period which information is used in a case where intermittent driving is carried out such that driving and a pause of the driving are repeated. The drive/pause information storage section 71 stores the information so that the information is rewritable for each of the still image and the moving image. This allows the drive/pause information storage section 71 to set the period ratio to be variable. It goes without saying that the setting of the period ratio can be freely changed.

According to the present embodiment, the period ratio of the still image between the drive period and the pause period is set to, for example, one frame to one frame. However, the present invention is not limited to this. The period ratio of the still image between the drive period and the pause period may be set to one frame to one or more frame.

Meanwhile, the period ratio of the moving image between the drive period and the pause period is set to, for example, ½ frame to ½ frame by providing the drive period and the pause period in one frame. However, the present invention is not limited to this. The period ratio of the moving image between the drive period and the pause period may be set to less than ½ frame to more than ½ frame.

The drive/pause switching section 72 reads out, in accordance with the image identification signal DIS, the period ratio of the still image or that of the moving image from the drive/pause information storage section 71, and generates, in accordance with the period ratio, a drive/pause control signal DSC which switches the start period and the pause period. For example, the drive/pause control signal DSC is a signal which is "H" during the drive period and is "L" during the pause period.

Moreover, the drive/pause switching section 71 can read out, in accordance with an external input command COM (command), the period ratio of the still image or that of the moving image from the drive/pause information storage section, and generate the drive/pause control signal DSC in accordance with the period ratio. The external input command COM, which is a command to specify a type of the input image regardless of a result of identification of the input image by the image identification section 6, is supplied from a control section of a device in which the display device 1 is incorporated. The drive/pause control section 7 carries out control in accordance with the external input command COM in priority to the image identification signal DIS.

In a case where the drive/pause control section 7 sets the period ratio, the timing control section 8 determines a drive frequency. Therefore, the period ratio is also used as drive frequency information.

<Configuration of Timing Control Section>

The timing control section 8 generates driver control signals in accordance with a timing signal TIM and the drive/pause control signal DSC. The driver control signals are the source start pulse SSP, the source clock SCK, the amplifier enable signal AE, the gate enable signal GOE, the gate start pulse GSP, and the gate clock GCK, which are described earlier. Moreover, the timing control section 8 supplies, to the source driver 3, the image data DA which is received via the image identification section 6.

Specifically, the timing control section 8 generates the amplifier enable signal AE so that the source amplifiers 31 of the source driver 3 operate during the drive period and stop operating during the pause period. For this reason, the timing control section 8 generates the amplifier enable signal AE so that the amplifier enable signal AE rises in synchronization with rising of a vertical synchronizing signal Vsync serving as the timing signal TIM, and so that the amplifier enable signal AE is "H" during the drive period and is "L" during the pause period (see (b) of FIG. 2). (b) of FIG. 2 shows a case where the drive period is shorter than a 1V period (one frame). In this case, the source amplifiers 31 of the source driver 3 operate so that driving is carried out in the first half of the one frame and the source amplifiers 31 stop operating so that the driving is paused in the second half of the one frame.

Meanwhile, the timing control section 8 generates the gate clock GCK and the gate enable signal GOE so that the gate driver 4 operates during the drive period and stops operating during the pause period. For this reason, the timing control section 8 outputs the gate clock GCK so that the gate clock GCK rises in synchronization with falling of the gate enable signal GOE during the drive period (see FIG. 3). Further, during the pause period, the timing control section 8 causes the gate enable signal GOE to be "H" (inactive) and stops outputting the gate clock GCK. According to this, the gate driver 4 outputs the gate signal during the drive period by receiving the gate clock GCK, and stops outputting the gate signal during the pause period by receiving no gate clock GCK.

Specifically, the timing control section 8 changes drive frequencies of the source driver 3 and the gate driver 4 so that one screenful of images is displayed during the drive period in accordance with the period ratio defined by the drive/pause control signal DSC. Meanwhile, the timing control section 8 stops operation of the source driver 3 and the gate driver 4 so that a display operation is paused during the pause period in accordance with the period ratio.

Furthermore, the timing control section 8 changes the drive frequency during the drive period in accordance with the period ratio. Assume here that driving carried out in a case where one screenful of images is displayed in one frame is the normal driving. Meanwhile, in a case where one screenful of images is displayed in a time period shorter than one frame, the timing control section 8 increases frequencies of the source clock SCK, the gate enable signal GOE, and the gate clock GCK so that the source driver 3 and the gate driver 4 are driven at a drive frequency higher than that at which the normal driving is carried out.

<Configuration of Power Supply Circuit>

FIG. 7 illustrates a configuration of a regulator 93 provided in the power supply circuit 9.

The power supply circuit 9 is a circuit which generates a power supply voltage to be applied to each of the source driver 3 and the gate driver 4. The power supply circuit 9 is also a circuit which generates a power supply voltage to be applied to each of the image identification section 6, the drive/pause control section 7, and the timing control section 8.

The power supply circuit 9 generates a plurality of different supply voltages to be applied to the respective sections in accordance with a single input supply voltage VCC. For this reason, the supply voltage 9 includes a DC/DC converter 91 and a regulator 92. The DC/DC converter 91 is a voltage circuit for boosting a low input supply voltage VCC. The regulator 92 is a circuit which generates a supply voltage to be applied to each of the sections in accordance with a voltage VDD supplied from the DC/DC converter 91.

The power supply circuit 9 particularly includes the regulator 93 serving as the regulator 92 for generating the supply voltage Vdd to be applied to each of the source amplifiers 31 (described earlier) (see FIG. 7). The regulator 93 includes a regulator IC94, capacitors C1 and C2, and resistors R1 and R2.

The capacitor C1, which is an input capacitor for stabilizing operation of the regulator 93, is connected between an input terminal IN of the regulator IC94 and a ground GND. The capacitor C2, which is a capacitor for preventing oscillation, is connected between an output terminal OUT of the regulator IC94 and the ground GND.

The resistors R1 and R2 are connected in series between the output terminal OUT and the ground GND. A connection point of the resistors R1 and R2 is connected to a control terminal ADJ of the regulator 94. This allows the control terminal ADJ to receive, as a feedback voltage, a voltage obtained by dividing the output voltage Vdd by the resistors R1 and R2. Further, the resistor R2 is a variable resistor.

In order that the feedback voltage received by the control terminal ADJ approaches the reference voltage, the regulator IC94 controls the voltage VDD received by the input terminal IN, and outputs the predetermined supply voltage Vdd via the output terminal OUT. Further, since the resistor R2 is the variable resistor, the regulator IC94 allows the supply voltage Vdd to be variable.

The regulator 93 (amplifier capability increasing means, amplifier capability reducing means) has a function of controlling a capability of the source amplifiers 31. Specifically, the regulator 93 adjusts a resistance of the resistor R2 so as to change the supply voltage Vdd, which determines the capability of the source amplifiers 31.

For example, the timing control section 8 adjusts the resistance of the resistor R2 by changing a set value which is set for a register provided in the source driver 3. Specifically, during the pause period, the timing control section 8 changes the set value to a low value, and instructs the regulator 93 to reduce the resistance of the resistor R2 in accordance with the set value thus changed. The regulator 93 reduces the resistance of the resistor R2 in accordance with the instruction. In this case, the set value is a value which makes it possible to obtain the supply voltage Vdd that reduces the capability of the source amplifiers 31 sufficiently enough to prevent the data signal from being outputted. Meanwhile, during the drive period, the timing control section 8 changes the set value to a high value, and instructs the regulator 93 to increase the resistance of the resistor R2 in accordance with the set value thus changed. The regulator 93 increases the resistance of the resistor R2 in accordance with the instruction.

[Operation of Display Device]

The following will discuss operation of (a method for driving) the display device 1 configured as described above.

[Common Operation]

First, according to the image identification section 6, the identification section 63 determines, with reference to a flag stored in the setting storage section 64, which of the normal drive mode and the intermittent drive mode is active. Note here that, in a case where the normal drive mode is active, the normal driving is carried out because the identification section 63 identifies no input image and the drive/pause control section 7 generates no drive/pause control signal DSC. Meanwhile, in a case where the intermittent drive mode is active, the image identification section 6 identifies the input image as below.

In a case where the image identification section 6 receives the image data DA, the comparison section 62 compares the image data DA with two successive input images retained by the frame memory 61, and the identification section 63 identifies the input images as still images or moving images (image identification step). The image identification section 6 outputs a result of the identification as the image identification signal DIS. The image data DA thus received is supplied to the timing control section 8 via the image identification section 6.

According to the drive/pause control section 7, the drive/pause switching section 72 reads out, in accordance with the image identification signal DIS, the period ratio from the drive/pause information storage section 71, the period ratio being in accordance with the still images or the moving images as which the input images are identified, and the drive/pause control signal DSC is generated in accordance with the period ratio (drive/pause controlling step). The period ratio stored in the drive/pause information storage section 71 is set to be variable by being rewritten as needed (ratio setting step). The drive/pause control section 7 which has received the external input command COM causes the drive/pause switching section 72 to generate the drive/pause control signal DSC in accordance with the external input command COM in priority to the drive/pause control signal DSC.

In the case of the normal drive mode, the timing control section 8 generates the driver control signals (described earlier) so that the normal driving is carried out. Then, the display section 2 is normally driven by the source driver 3 and the gate driver 4. This causes the display section 2 to display an image in accordance with the image data DA supplied from the image identification section 6 via the timing control section 8.

In the case of the intermittent drive mode, the timing control section 8 generates the driver control signals so that the intermittent driving is carried out. Then, the display section 2 is driven by the source driver 3 and the gate driver 4 so that the drive period and the pause period are repeated at the period ratio. This causes the display section 2 to display an image in accordance with the image data DA supplied as in the case of the normal driving mode.

During the pause period, in which the gate enable signal GOE is "H", the gate driver 4 outputs no gate signal. Meanwhile, since the amplifier enable signal AE is "L" in the source driver 3, the source amplifiers 31 of the source driver 3 stop operating. In this case, outputs of the source amplifiers 31 and the respective source lines SL are disconnected from each other.

Note that during the pause period, the source lines SL may be in an electrically floating state or a state in which the supply voltage Vdd or the like is applied, other than a state of the disconnection mentioned above. Alternatively, it is possible to provide a circuit for connecting/disconnecting an interface for signal transmission to/from the timing control section 8 and the source driver 3. In a case where such a circuit is used, the operation of the source driver 3 is stopped during the pause period, in which the drive/pause control signal DSC prevents signal transmission to the source driver 3.

Switching from Normal Drive Mode to First Intermittent Drive Mode

Example 1

(a) of FIG. 8 shows a drive pattern in the normal drive mode. (b) of FIG. 8 shows a drive pattern in the first intermittent drive mode. (a) of FIG. 9 shows electric power consumption in a case where a still image is displayed in the drive pattern shown in (a) of FIG. 8. (b) of FIG. 9 shows electric power consumption in a case where a still image is displayed in the drive pattern shown in (b) of FIG. 8.

In the normal drive mode, refresh driving is carried out such that a still image and a moving image are each rewritten for each frame (see (a) of FIG. 8).

In a case where the drive mode is switched from the normal drive mode to the first intermittent drive mode and the image identification section 6 identifies an input image as a still image, the intermittent driving is carried out with respect to the still image. In this case, for example, the period ratio between the drive period and the pause period is set to one frame to one frame. According to this example, driving and a pause of driving of the still image are alternately repeated for each frame (see (b) of FIG. 8).

<Comparison of Electric Power Consumption Between the Normal Drive Mode and the First Intermittent Drive Mode>

In the normal drive mode, in which an image is rewritten by driving successively carried out in each frame, two successive frames (the Nth frame and the (N+1)th frame) are driven (see (a) of FIG. 9). In this case, 400 mW of electric power is used to drive the display panel of the display section 2 and 100 mW of electric power is used as other electric power. Note here that other electric power, which is electric power other than the electric power used to drive the display panel, is electric power which is not directly involved in the refresh driving of the display panel and is used for a section such as the power supply circuit for causing the circuit which carries out the refresh driving to operate, and is independent of a drive frequency.

Meanwhile, in the first intermittent drive mode, in which an image is rewritten every other frame, the image is rewritten in the Nth frame, in which driving is carried out, whereas the image is not rewritten in the (N+1)th frame, in which the driving is paused (see (b) of FIG. 9). In this case, in the Nth frame, 400 mW of electric power is used to drive the display panel and 100 mW of electric power is used as other electric power. However, in the (N+1)th frame, no electric power is used to drive the display panel of the display section 2, and 40 mW of electric power is merely used as other electric power.

As described above, driving carried out over two frames in the first intermittent drive mode allows a reduction in electric power by 460 mW as compared with the driving in the normal drive mode.

Switching from Normal Drive Mode to Second Intermittent Drive Mode

Example 2

(a) of FIG. 10 shows a drive pattern in the normal drive mode. (b) of FIG. 10 shows a drive pattern in the second intermittent drive mode. (a) of FIG. 11 shows electric power consumption in a case where a moving image is displayed in the drive pattern shown in (a) of FIG. 10. (b) of FIG. 11 shows electric power consumption in a case where a still image is displayed in the drive pattern shown in (b) of FIG. 10.

In the normal drive mode, refresh driving is carried out such that a still image and a moving image are each rewritten for each frame (see (a) of FIG. 10).

In a case where the drive mode is switched from the normal drive mode to the second intermittent drive mode and the image identification section 6 identifies an input image as a still image or a moving image, the intermittent driving is carried out with respect to the still image or the moving image thus identified. In this case, for example, in the case of the still image, the period ratio between the drive period and the pause period is set to one frame to one frame as in the case of the first intermittent drive mode. Meanwhile, in the case of the moving image, the period ratio between the drive period and the pause period is set to ½ frame to ½ frame. According to this example, driving of the moving image is carried out in the former ½ frame of one frame and the driving of the moving image is paused in the latter ½ frame of the one frame (see (b) of FIG. 10). A drive frequency in this case is 120 Hz in a case where the drive frequency of one frame is 60 Hz.

<Comparison of Electric Power Consumption Between the Normal Drive Mode and the Second Intermittent Drive Mode>

In the normal drive mode, in order that a moving image is displayed, an image is rewritten by driving carried out in one frame (see (a) of FIG. 11). In this case, 400 mW of electric power is used to drive the display panel and 100 mW of electric power is used as other electric power.

Meanwhile, in the second intermittent drive mode, the image is rewritten in the first half of one frame, in which driving is carried out, whereas the image is not rewritten in the second half of the one frame, in which the driving is paused (see (b) of FIG. 11). In this case, in the first half of the one frame, 400 mW of electric power is used to drive the display panel as in the case of the normal drive mode and 50 mW of electric power is used as other electric power. However, in the second half of the one frame, no electric power is used to drive the display panel, and 20 mW of electric power is merely used as other electric power.

As described above, driving carried out in one frame in the second intermittent drive mode allows a reduction in electric power by 30 mW as compared with the driving in the normal drive mode.

Increase of Driving Capability of Source Amplifier

Example 3

In the second intermittent drive mode, a smaller ratio of the driving period of one frame (i.e., a higher drive frequency) causes a further reduction in electric power consumption.

However, a higher drive frequency may prevent a voltage applied to a pixel PIX from reaching a predetermined voltage due to an influence of a wiring capacitor C defined by a source line SL. This problem can be solved as below. In a case where the capability of the source amplifiers 31 is increased, the voltage applied to the pixel PIX can be increased to reach the predetermined voltage. In order to increase the capability of the source amplifiers 31, it is only necessary to increase the supply voltage Vdd.

In a case where a drive frequency is increased, even if the voltage applied to the pixel PIX is sufficiently secured by increasing the capability of the source amplifiers 31 as described above, a characteristic of the liquid crystal capacitor C may prevent the voltage applied to a liquid crystal of the pixel PIX from reaching the predetermined voltage. In order to solve this problem, it is preferable that before being driven, a pixel PIX in a line to be driven receive a precharge voltage from the precharge circuit 5 or by the precharge functions of the source driver 3 and the gate driver 4. Specifically, it is preferable that a pixel PIX to be driven receive a precharge voltage while a line two or three lines before the line in which the pixel PIX to be driven is provided is being driven. According to this, also in a case where the voltage applied to the liquid crystal is insufficient even after the capability of the source amplifiers 31 is increased, the voltage applied to the liquid crystal can be sufficiently increased.

[Thin Film Transistor]

According to the display device 1 illustrated in FIG. 1, it is preferable that a TFT which includes a semiconductor layer made of a so-called oxide semiconductor be used as the transistor T (thin film transistor, TFT) included in each of the plurality of pixels PIX of the display section 2. For example, the oxide semiconductor includes IGZO (InGaZnOx). A reason for this will be discussed below with reference to FIG. 12.

FIG. 12 is a graph showing characteristics of various TFTs. FIG. 12 shows characteristics of respective TFTs, which are a TFT in which an oxide semiconductor is used, a TFT in which a-Si (amorphous silicon) is used, and a TFT in which LTPS (Low Temperature Poly Silicon) is used. In FIG. 12, a horizontal axis (Vgh) indicates a value of an on-state voltage supplied to a gate of each of the TFTs, and a vertical axis (Id) indicates a value of an electric current applied between a source and a drain of each of the TFTs. In particular, a time period indicated by "TFT-on" in FIG. 12 shows a time period in which a TFT is in an on state in accordance with the value of the on-state voltage. A time period indicated by "TFT-off" in FIG. 12 shows a time period in which a TFT is in an off state in accordance with the value of the on-state voltage.

The TFT in which the oxide semiconductor is used is higher in current value (i.e., electron mobility) in the on state than the TFT in which the a-Si is used (see FIG. 12). Specifically, the TFT in which the a-Si is used has an Id current of 1 uA during the TFT-on, whereas the TFT in which the oxide semiconductor is used has an Id current of approximately 20 uA to 50 uA during the TFT-on (not shown in FIG. 12). This reveals that the TFT in which the oxide semiconductor is used is approximately 20 to 50 times higher in electron mobility in the on state than the TFT in which the a-Si is used, and the TFT in which the oxide semiconductor is used has an excellent on characteristic.

As described above, in a case where the TFT in which the oxide semiconductor is used is employed for the TFT of the each of the plurality of pixels PIX, the display device 1 of the present embodiment has the excellent on characteristic. This increases electron mobility during writing of pixel data to the each of the plurality of pixels PIX, so that the writing of the pixel data can be carried out in a shorter time.

Summary of Embodiment

As has been described above, since the display device 1 of the present embodiment includes the image identification section 6 and the drive/pause control section 7, the display device 1 drives the display section 2 in the second intermittent drive mode in a case where an input image is identified as a moving image. According to this, in a case where an input image is switched from a still image to a moving image, it is possible to switch the drive mode to the second intermittent drive mode without the need of giving a special external instruction. Moreover, the drive/pause control section 7 which freely gives an instruction with use of the external input command COM can control the source driver 3 and the gate driver 4 as desired to drive the display section 2.

The display device 1 which introduces the second intermittent drive mode pauses the driving after completion of the refresh driving in less than one frame. According to this, the display device 1 increases a drive frequency without lowering a display quality of a moving image. This allows a reduction in electric power consumption in units of frames. Therefore, unlike the case of Patent Literature 1, the display device 1 can flexibly reduce electric power consumption without causing a deterioration in display quality of a moving image by providing a long pause period.

Further, it is possible to set any period ratio, which is stored in the drive/pause information storage section 71. This makes it possible to change a period ratio (drive frequency) in accordance with performance of the display device 1 or a state of an input image.

In a case where the capability of the source amplifiers 31 is increased, a voltage applied to a pixel PIX can be sufficiently secured even if the drive frequency is increased. In addition to this, in a case where a precharge voltage is applied by the precharge circuit 5 to a pixel PIX which has not been driven, a voltage applied to a liquid crystal of the pixel PIX can be sufficiently secured even if the drive frequency is increased. This can prevent a deterioration in display quality of a moving image in a case where the drive frequency is increased.

Moreover, in a case where operation of the source amplifiers 31 is stopped during the pause period, it is possible to further reduce electric power consumption during the pause period. Alternatively, instead of stopping the operation of the source amplifiers 31 during the pause period, it is possible to carry out control so that the capability of the source amplifiers 31 is sufficiently low enough to prevent the data signal from being outputted. In order to set the capability of the source amplifiers 31 to be low, it is only necessary to reduce the supply voltage Vdd.

Note that a state in which the capability of the source amplifiers 31 is the lowest corresponds to a state in which the operation of the source amplifiers 31 is stopped.

Instead of stopping the operation or reducing the capability of the source amplifiers 31 during the pause period, it is possible to disconnect the source amplifiers 31 from the respective source lines SL. Therefore, for example, it is possible to provide a buffer between the source amplifiers 31 and the respective source lines SL so that an output of the buffer is in a high-impedance state during the pause period.

The source driver 4 outputs no gate signal (i.e., the source driver 4 fixes an output to "L") during the pause period. This makes it possible to reduce electric power consumption by the source driver 4 during the pause period. In addition, it is also possible to prevent the data signal from being written to a pixel PIX during the pause period.

[Additional Descriptions]

The display device 1 of the present embodiment can also be described as below.

The display device 1 includes: a plurality of pixels provided in a matrix pattern; a drive circuit which supplies a data signal to each of the plurality of pixels by line-sequentially selecting the plurality of pixels; an image identification section for identifying an input image as a still image or a moving image; a drive/pause controlling section for controlling the drive circuit so that a drive period in which driving is carried out and a pause period in which the driving is paused are provided in one frame in a case where the image identification section identifies the input image as the moving image and so that the drive period and the pause period are provided in units of one or more frames in a case where the image identification section identifies the input image as the still image; and a ratio setting section for setting a time ratio between the drive period and the pause period so that the time ratio is variable for each of the still image and the moving image.

The display device 1 is preferably configured such that the drive circuit includes a data signal output circuit which outputs the data signal that is supplied to the each of the plurality of pixels via an amplifier provided in an output stage, the display device 1 further including an amplifier capability increasing section for increasing, during the drive period, capability of the amplifier sufficiently enough for a voltage applied to the each of the plurality of pixels to reach a predetermined voltage.

An increase in drive frequency due to a reduction in time ratio of the drive period may prevent a voltage applied to the each of the plurality of pixels from reaching the predetermined voltage due to an influence of a wiring capacitor of a display section. In order to solve this problem, according to the configuration, since the capability of the amplifier is increased by the amplifier capability increasing section, the voltage applied to the each of the plurality of pixels can be sufficiently secured.

The display device 1 is preferably configured to further include a precharging section for applying, in advance of the driving, the predetermined voltage to the each of the plurality of pixels during the drive period.

In a case where a drive frequency is increased, even if the voltage applied to the each of the plurality of pixels is sufficiently secured by increasing the capability of the amplifier as described above, the voltage applied to a liquid crystal of the each of the plurality of pixels may not reach the predetermined voltage in a case where the each of the plurality of pixels includes the liquid crystal. In order to solve this problem, according to the configuration, the precharge section applies, in advance of the driving, the predetermined voltage to the each of the plurality of pixels. This allows the voltage applied to the liquid crystal to be sufficiently increased.

The display device 1 is preferably configured such that: the drive circuit includes a data signal output circuit which outputs the data signal that is supplied to the each of the plurality of pixels via an amplifier provided in an output stage, the display device 1 further including an amplifier capability reducing section for reducing, during the pause period, capability of the amplifier sufficiently enough to prevent the data signal from being outputted.

According to the configuration, the amplifier capability reducing section reduces the capability of the amplifier during the pause period. This allows a further reduction in electric power consumption.

The display device 1 is preferably configured such that: the drive circuit includes a selection circuit which line-sequentially selects the plurality of pixels to each of which the data signal is supplied; and the selection circuit selects none of the plurality of pixels during the pause period.

Normally, the selection circuit electrically selects the each of the plurality of pixels as in the case of the gate driver. Therefore, according to the configuration in which none of the plurality of pixels is selected during the pause period, the selection circuit can reduce electric power consumption.

The display device 1 is preferably configured such that the drive/pause controlling section controls the drive circuit in accordance with an external command.

According to the configuration, the drive/pause control section controls the drive circuit in accordance with the external command. This makes it possible to control the drive circuit as desired by freely giving a command.

The display device 1 is preferably configured such that the display device is a liquid crystal display device. This allows a reduction in electric power consumption in units of frames also in the liquid crystal display device.

The display device 1 is preferably configured such that a semiconductor layer of a thin film transistor included in the each of the plurality of pixels is made of an oxide semiconductor. In particular, the display device 1 is preferably configured such that the oxide semiconductor is IGZO. This allows the thin film transistor to have an excellent on characteristic.

The present embodiment discusses an example in which the display device 1 is a liquid crystal display device. However, it goes without saying that a display device of the present invention is not limited to a liquid crystal display device. For example, the present invention is also applicable to another display device such as an organic electroluminescence display device which includes a driver which can cause a drive frequency to be variable during a display of a moving image (described earlier).

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

A display device of the present invention appropriately carries out driving when a still image or a moving image is displayed. Therefore, the display device is suitably usable for display devices such as a liquid crystal display device and an organic electroluminescence display device.

REFERENCE SIGNS LIST

1: Display device
3: Source driver (drive circuit, data signal output circuit, precharging means)
4: Gate driver (drive circuit, selection circuit, precharging means)
5: Precharge circuit (precharging means)
6: Image identification section
7: Drive/pause control section
8: Timing control section (precharging means)
31: Source amplifier (amplifier)
61: Frame memory
62: Comparison section
63: Identification section
64: Setting storage section
71: Drive/pause information storage section (ratio setting means, storage means)

72: Drive/pause switching section
93: Regulator (amplifier capability increasing means, amplifier capability reducing means)
C: Liquid crystal capacitor
COM: External input command
DA: Image data
DIS: Image identification signal
DSC: Drive/pause control signal
GL: Gate line
PIX: Pixel
SL: Source line
T: Transistor (thin film transistor)

The invention claimed is:

1. A display device comprising:
a plurality of pixels provided in a matrix pattern;
a drive circuit which supplies a data signal to each of the plurality of pixels by line-sequentially selecting the plurality of pixels;
an image identification controller configured or programmed to identify an input image as a still image or a moving image;
a drive/pause controller configured or programmed to control the drive circuit so that a drive period in which driving is carried out and a pause period in which the driving is paused are provided in one frame in a case where the image identification controller identifies the input image as the moving image and so that the drive period and the pause period are provided in units of one or more frames having fixed frame lengths in a case where the image identification controller identifies the input image as the still image; and
a ratio setting controller configured or programmed to set a time ratio between the drive period and the pause period so that the time ratio is variable for each of the still image and the moving image; wherein
the display device is driven in both a normal drive mode and an intermittent drive mode, where:
in the normal drive mode a refresh driving is performed such that the still image and the moving image are both rewritten for each frame; and
in the intermittent drive mode, (i) when the image identification controller identifies the input image as the moving image, driving of the moving image is carried out in a first portion of a single frame and driving of the moving image is paused in a second portion of the single frame immediately following the first portion of the single frame, and (ii) when the image identification controller identifies the input image as the still image, driving of the still image is carried out in a first frame and driving of the still image is paused in a second frame immediately following the first frame.

2. The display device as set forth in claim 1, wherein the ratio setting controller includes a storage configured to store the time ratio so that the time ratio is rewritable.

3. The display device as set forth in claim 1, wherein:
the drive circuit includes a data signal output circuit which outputs the data signal that is supplied to the each of the plurality of pixels via an amplifier provided in an output stage,
said display device further comprising an amplifier capability increasing circuit which is configured to increase, during the drive period, an output of the amplifier sufficiently enough for a voltage applied to the each of the plurality of pixels to reach a predetermined voltage by increasing a supply voltage applied to the amplifier.

4. The display device as set forth in claim 3, further comprising:
a precharging circuit configured to apply, in advance of the driving, the predetermined voltage to the each of the plurality of pixels during the drive period.

5. The display device as set forth in claim 1, wherein:
the drive circuit includes a data signal output circuit which outputs the data signal that is supplied to the each of the plurality of pixels via an amplifier provided in an output stage,
said display device further comprising an amplifier capability reducing circuit which is configured to reduce, during the pause period, an output of the amplifier sufficiently enough to prevent the data signal from being outputted by decreasing a supply voltage applied to the amplifier.

6. The display device as set forth in claim 1, wherein:
the drive circuit includes a selection circuit which line-sequentially selects the plurality of pixels to each of which the data signal is supplied; and
the selection circuit does not select any of the plurality of pixels during the pause period.

7. The display device as set forth in claim 1, wherein the drive/pause controller is configured or programmed to control the drive circuit in accordance with an external command.

8. The display device as set forth in claim 1, wherein the display device is a liquid crystal display device.

9. The display device as set forth in claim 8, wherein a semiconductor layer of a thin film transistor included in the each of the plurality of pixels is made of an oxide semiconductor.

10. The display device as set forth in claim 9, wherein the oxide semiconductor is IGZO.

11. A method for driving a display device including: a plurality of pixels provided in a matrix pattern; and a drive circuit which supplies a data signal to each of the plurality of pixels by line-sequentially selecting the plurality of pixels,
said method comprising:
an image identification step of identifying an input image as a still image or a moving image;
a drive/pause controlling step of controlling the drive circuit so that a drive period in which driving is carried out and a pause period in which the driving is paused are provided in one frame in a case where the input image is identified as the moving image in the image identification step and so that the drive period and the pause period are provided in units of one or more frames having fixed frame lengths in a case where the input image is identified as the still image in the image identification step;
a ratio setting step of setting a time ratio between the drive period and the pause period so that the time ratio is variable for each of the still image and the moving image; and
a driving step of driving the display device in both a normal drive mode and an intermittent drive mode, where:
in the normal drive mode a refresh driving is performed such that the still image and the moving image are both rewritten for each frame; and
in the intermittent drive mode, (i) when the image identification controller identifies the input image as the moving image, driving of the moving image is carried out in a first portion of a single frame and driving of the moving image is paused in a second portion of the single frame immediately following the first portion of the single frame, and (ii) when the image identification controller identifies the input image as the still image, driving of the still image is carried out in a first frame and driving of the still image is paused in a second frame immediately following the first frame.

* * * * *